US005326298A

United States Patent [19]

Hotomi

[11] Patent Number: 5,326,298

[45] Date of Patent: Jul. 5, 1994

[54] LIGHT EMITTER FOR GIVING PLASMA LIGHT EMISSION

[75] Inventor: Hideo Hotomi, Osaka, Japan

[73] Assignee: Minolta Camera Co., Ltd., Osaka, Japan

[21] Appl. No.: 32,439

[22] Filed: Mar. 16, 1993

Related U.S. Application Data

[63] Continuation of Ser. No. 857,093, Mar. 20, 1992, abandoned, which is a continuation of Ser. No. 379,492, Jul. 13, 1989, abandoned.

[30] Foreign Application Priority Data

Jul. 14, 1988 [JP] Japan ..... 63-176157

[51] Int. Cl.[5] ..... H01J 9/24; H01J 9/395

[52] U.S. Cl. ..... 445/24; 445/38; 445/53; 313/502

[58] Field of Search ..... 313/582, 502, 231.61, 313/484, 509, 583, 584, 585; 340/317, 718, 776; 445/6, 24, 23, 38, 53

[56] References Cited

U.S. PATENT DOCUMENTS

| | | | |
|---|---|---|---|
| 2,644,113 | 6/1953 | Etzkorn | 313/485 X |
| 3,152,994 | 10/1964 | Thornton, Jr. et al. | 313/494 X |
| 3,317,728 | 5/1967 | Hamann | 313/485 X |
| 3,559,190 | 1/1971 | Bitzer et al. | 313/484 X |
| 3,749,971 | 7/1973 | Petty | 340/718 X |
| 3,848,248 | 11/1974 | MacIntyre, Jr. | 313/584 X |
| 3,896,327 | 7/1975 | Schermerhorn | 313/485 |
| 4,006,383 | 2/1977 | Luo et al. | 340/718 X |
| 4,035,690 | 7/1977 | Roeber | 313/586 X |
| 4,276,244 | 6/1981 | György et al. . | |
| 4,333,040 | 6/1982 | Okamoto et al. | 313/494 X |
| 4,849,674 | 7/1989 | Cherry et al. | 445/6 |
| 5,198,479 | 3/1993 | Shiobara et al. . | |

OTHER PUBLICATIONS

Electronics Technology Series No. 4, Up-To-Date Technology of Display Element and Device: Dec. 1985 edition, pp. 266-273 (with English translation of pp. 266-270).

*Primary Examiner*—Donald J. Yusko
*Assistant Examiner*—Matthew J. Esserman
*Attorney, Agent, or Firm*—Willian Brinks Hofer Gilson & Lione

[57] ABSTRACT

A light emitter for giving plasma light emission upon application of an electric field. The light emitter comprises a resin including fine bubbles in which a gas is trapped. The gas is selected from rare gases, hydrocarbon gas and nitrogen gas. This light emitter is applicable to a light emitting device such as a plasma display.

25 Claims, 3 Drawing Sheets

LIGHT EMITTER FOR GIVING PLASMA LIGHT EMISSION

This application is a continuation of application Ser. No. 07/857,093, filed Mar. 20, 1992, now abandoned which, in turn, is a continuation of application Ser. No. 07/379,492, filed Jul. 13, 1989, now abandoned.

FIELD OF THE INVENTION

The present invention relates to a light emitter for use in a display panel or the like. More particularly, the invention relates to a light emitter for giving plasma light emission upon application of an electric field.

BACKGROUND OF THE INVENTION

Known display panels and the like utilize plasma light emission besides CRT, liquid crystal and electroluminescence.

In manufacturing a conventional plasma display utilizing plasma light emission, a space between opposed glass substrates is evacuated first, and then a rare gas such as neon, argon or xenon gas is supplied under low pressure to the evacuated space. The space is thereafter sealed gastight to prevent gas leakage.

There are possibilities of discharge, shifting and crosstalk when using light emitting elements of the conventional plasma display. To check such drawbacks, the glass substrates for enclosing a rare gas are cut with high precision or partition inductors are provided for separating the light emitting elements from one another.

It is, however, difficult to enclose a rare gas between the glass substrates and seal the peripheries thereof to prevent gas leakage. Further, it is troublesome, very difficult and costly to cut the glass substrates with high precision or to provide the partition inductors for separating the light emitting elements. It is particularly difficult to manufacture a large plasma display, and hence the conventional plasma display is not suited for use as a large outdoor advertising display panel or the like.

SUMMARY OF THE INVENTION

A primary object of the present invention is to provide a light emitter which greatly facilitates manufacture of plasma displays and the like and which facilitates manufacture of large displays.

Another object of the invention is to provide a light emitting device manufactured by utilizing such light emitters.

The primary object noted above is fulfilled, according to the present invention, by a light emitter for giving plasma light emission upon application of an electric field, comprising a resin including fine, randomly dispersed bubbles in which a gas is trapped, the gas being selected from the group consisting of rare gases, hydrocarbon gas and nitrogen gas.

The resin used in the above light emitter may be any one of known insulating thermoplastic resins, thermosetting resins, photosetting resins and photoluminescence resins.

Suitable resins include, without limiting thereto, saturated polyester resins, polyamide resins, acrylic resins, ethylene-vinyl acetate copolymer, ion-linked olefin copolymer (ionomer), styrene-butadiene block copolymer, polycarbonate, vinyl chloride-vinyl acetate copolymer, cellulose ester, polyamide and other thermoplastic resins, epoxy resin, urethane resin, silicon resin, melamine resin, xylene resin, alkyd resin, thermosetting acrylic resins and other thermosetting resins, photosetting resins, poly-N-vinyl carbazole, polyvinyl pyrene, and polyvinyl anthracene.

These insulating resins, when measured alone, should desirably have a volume resistivity of at least $1\times10^{13}$ Ω.cm.

According to the present invention, fine bubbles are generated in one of the above insulating resins for trapping a rare gas such as helium, neon, argon, krypton, xenon or radon gas, a hydrocarbon gas such as $CH_2$, $C_2H_6$ or $C_3H_8$ gas, or nitrogen gas. These gases may be trapped singly or in combination.

Various devices may be used for generating fine bubbles in the insulating resin to trap such gas or gases. One example of such devices will be explained with reference to FIG. 1.

A resin solution 11*a* having one of the above resins dissolved in an appropriate solvent is placed in a vessel 1. The vessel 1 is set in position inside a vacuum apparatus 2 so that agitating vanes 3*a* attached to a lower end of an agitating shaft 3 are immersed in the resin solution 11*a* contained in the vessel 1. The vacuum apparatus 2 is evacuated, and one or more of the gases mentioned above is/are supplied from a gas cylinder 4 to fill the apparatus 2.

The agitating shaft 3 is rotated to agitate the resin solution 11*a* with the agitating vanes 3*a*, thereby to generate fine bubbles for trapping the gas or gases that fill(s) the vacuum apparatus 2.

To increase concentration of the fine bubbles in the resin, the viscosity of resin solution 11*a* may be reduced, the rotational rate of agitating shaft 3 may be increased, the number of agitating vanes 3*a* may be increased to intensify the agitating state, or a solvent having a high vapor pressure may be used for dissolving the resin.

The foregoing gases give light emission of the following colors: helium—bluish white, neon—red, argon—red, krypton—reddish white, xenon—bluish white, radon—white, hydrocarbon—whitish yellow, and nitrogen—white. A fluorescent material may be dispersed in the resin for varying an emission wavelength of the light emitter. The fluorescent material may comprise a host crystal of halide, sulfide, oxide, phosphate, silicate, aluminate, borate, or vanadate, which is baked after mixing thereto impurity ions in at least several ppm to act as an emission center. Specifically, fluorescent materials giving green light include $Zn_2SiO_4$:Mn, ZnS:Cu, ZnS:Au, ZnS:Al, CdS:Cu, CdS:Al, $Y_2O_2S$:Tb, $Cd_2O_2S$:Tb, $Zn_2SiO_4$:Mn, and ZnO:Zn. Materials giving red light include $Y_2O_2S$:Eu, and $Y_2O_3S$:Eu. Materials giving blue light include ZnS:Ag, ZnS:Cl, and CsI:Na. Materials giving yellow light include ZnS:Au. Materials giving white light include $3Ca_3(PO_4)_2$ CaF:Sb, $3Ca_3(PO_4)_2$. CaF:Mn, $3Ca_3(PO_4)_2$. CaCl:Sb, and $3Ca_3(PO_4)_2$. CaCl:Mn. Materials emitting light over an entire visible range by varying the amount of cadmium include CdS:Ag. Other feasible materials include $YPO_4$:Eu, and $YVO_4$:Eu.

The second object of the invention, i.e. to provide a light emitting device utilizing the foregoing light emitter, is fulfilled by a light emitting device comprising a support member, a first electrode formed on said support member, a light emitting resin layer including fine bubbles trapping a gas, said gas being selected from the group consisting of rare gases, hydrocarbon gases and nitrogen gas, and a second electrode formed on said light emitting layer.

in this case, the fine bubbles formed in the resin should preferably have sizes smaller than an electrode for one pixel. In manufacturing the above light emitting device, the resin including the fine bubbles in which the foregoing rare gas, hydrocarbon gas or nitrogen gas is trapped is placed, such as by coating, on a glass substrate or the like carrying electrodes. Consequently, when an electric field is applied to the electrodes, the gas trapped in the fine bubbles gives plasma light emission.

In short, the light emitter according to the present invention comprises a resin including fine bubbles of a gas selected from rare gases, hydrocarbon gases and nitrogen gas. In manufacturing a light emitting device, this light emitter is placed, such as by coating, on a glass substrate or the like.

Thus, for using the light emitter in a plasma display or the like, the light emitter may simply be applied to a glass plate on which electrodes are formed. It is no longer necessary to take a troublesome step, as practiced heretofore, of filling a rare gas into a space between glass substrates and sealing the periphery thereof to prevent gas leakage. It is also unnecessary, according to the present invention, to cut the glass substrates with high precision for holding the rare gas in a leakproof manner, or to provide partition inductors as in the prior art, in order to avoid discharge shifting and other inconveniences.

The light emitter according to the present invention, therefore, greatly facilitates manufacture of plasma displays and the like, and realizes a substantial reduction of the manufacturing cost. Further, this light emitter readily enables manufacture of large plasma displays which may be used to provide large screens such as outdoor advertising panels.

The foregoing and other objects, features and advantages of the invention will be apparent from the following more particular description of preferred embodiments of the invention, as illustrated in the accompanying drawings.

DESCRIPTION OF THE PREFERRED EMBODIMENTS

Figure 1:
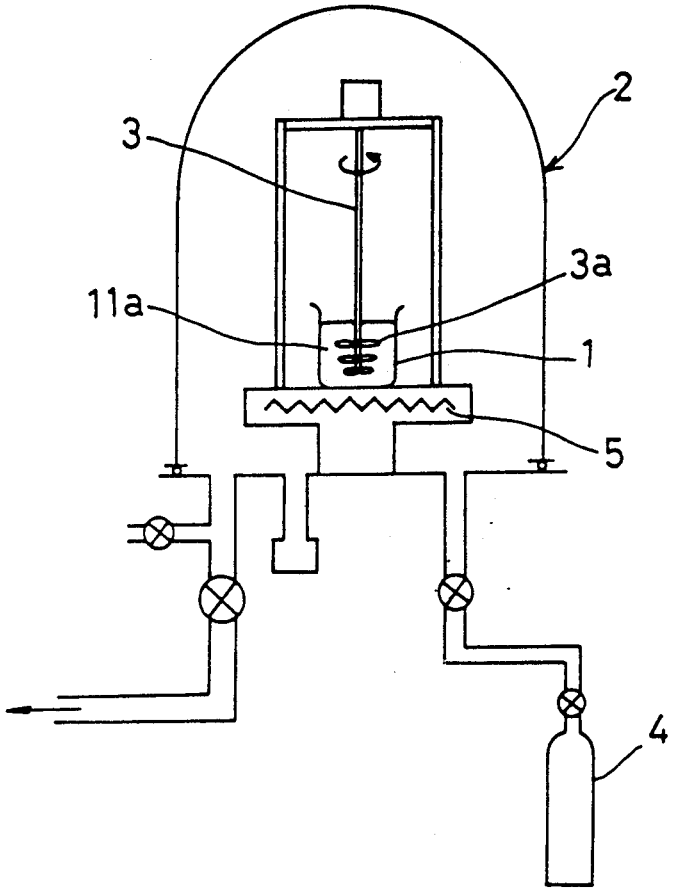
FIG. 1 is a schematic sectional view showing an example of apparatus for manufacturing a light emitting member according to the present invention.

In a first embodiment, a light emitting element 10 is manufactured by using epoxy resin as an insulating resin 11 and using a vacuum apparatus 2 as shown in FIG. 1.

First, a resin solution 11*a* having epoxy resin 11 dissolved in toluene was placed in a vessel 1. The vessel 1 was set in position inside the vacuum apparatus 2 so that agitating vanes 3*a* attached to a lower end of an agitating shaft 3 were immersed in the expoxy resin solution 11*a* contained in the vessel 1.

Figure 3:
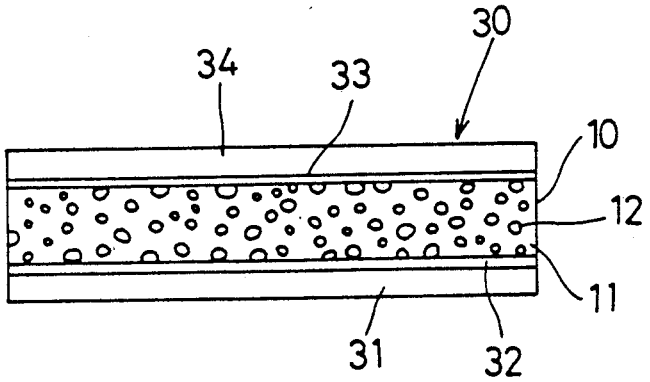
FIG. 3 is a sectional view of another light emitting device employing the light emitting member according to the present invention.
Figure 4:
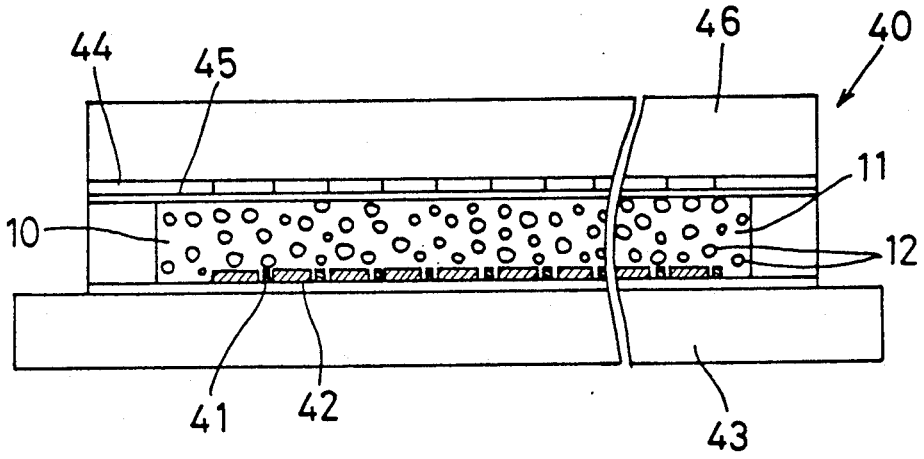
FIG. 4 is a schematic sectional view of a plasma display employing the light emitting member according to the present invention.

The vacuum apparatus 2 was evacuated by a mechanical booster pump and rotary pump (not shown) to $1\times10^{-3}$ Torr or less. The pump for evacuating the vacuum apparatus 2 may be a molecule turbo pump or the like. Then, argon gas was supplied from a gas cylinder 4 to fill the apparatus 2 to a pressure of 700 Torr. The agitating shaft 3 was rotated while a temperature of about 45° C. was maintained by a heater 5. The epoxy resin solution 11*a* was thus agitated by the agitating vanes 3*a*, to generate fine, randomly dispersed bubbles 12 as illustrated in FIGS. 2A, 3 and 4 for trapping argon gas that filled the vacuum apparatus 2.

Subsequently, the vessel 1 was removed from the vacuum apparatus 2. The epoxy resin solution 11*a* including a multiplicity of fine bubbles 12 of argon gas was used as the light emitting element 10. An example of light emitting devices using the above light emitting element 10 will be described next.

Figure 2A:
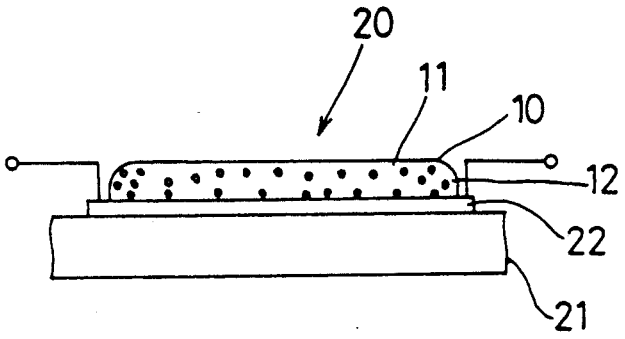
FIGS. 2A and 2B are a sectional view of an example of a light emitting device employing the light emitting member according to the present invention, and a plan view of interdigital electrodes formed on the light emitting device.
Figure 2B:
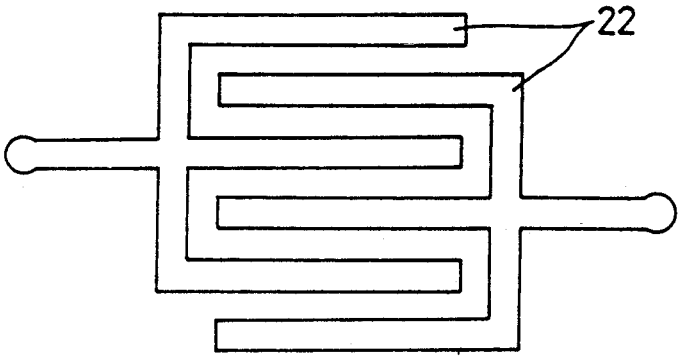

FIG. 2A shows a light emitting device 20 having a glass substrate 21 on which interdigital chrome electrodes 22 as shown in FIG. 2B are formed by sputtering. These electrodes 22 had a film thickness of 8000 Å, an electrode pitch of 100 μm and an electrode width of 100 μm.

Next, the light emitting element 10 was applied in a film thickness of about 15 μm to the glass substrate 21 with the interdigital electrodes 22 formed thereon.

When electricity with a frequency of 800 Hz and at 1000 V was applied to the interdigital electrodes 22 of the light emitting device 20, the argon gas trapped in the fine bubbles 12 of the resin 11 gave plasma light emission.

Referring to FIG. 3, a light emitting device 30 had a 1 mm thick glass substrate 31 on which an aluminum electrode 32 was formed in a film thickness of 3000 Å. The light emitting element 10 was coated in a film thickness of 20 μm on the aluminum electrode 32.

Next, an ITO transparent electrode 33 was formed in a film thickness of 3000 Å on the light emitting element 10, with a 1 mm thick glass plate 34 placed on top.

The glass plate 34 placed on the ITO transparent electrode 33 comprised a non-reflecting glass plate or the like to act as a protective layer and filter.

When the foregoing voltage was applied between the aluminum electrode 32 and ITO electrode 33 sandwiching the light emitting element 10, the argon gas trapped in the fine bubbles 12 of the resin 11 gave plasma light emission. The light was reflected by the aluminum electrode 32 which resulted in light emission through the ITO transparent electrode 33.

Next, an example in which the above light emitting element 10 is applied to a plasma display will be described with reference to FIGS. 4 and 5.

As shown in FIG. 4, the plasma display 40 has the light emitting element 10 disposed between a glass substrate 43 and a glass plate 46. The glass substrate 43 carries film transistors, a-SiTFTs, 41 utilizing amorphous silicon, and aluminum electrodes 42 formed on a surface of the substrate 43. The glass plate 46 includes an RGB micro-color filter 44 and a common transparent electrode 45 formed on a surface thereof.

Figure 5:
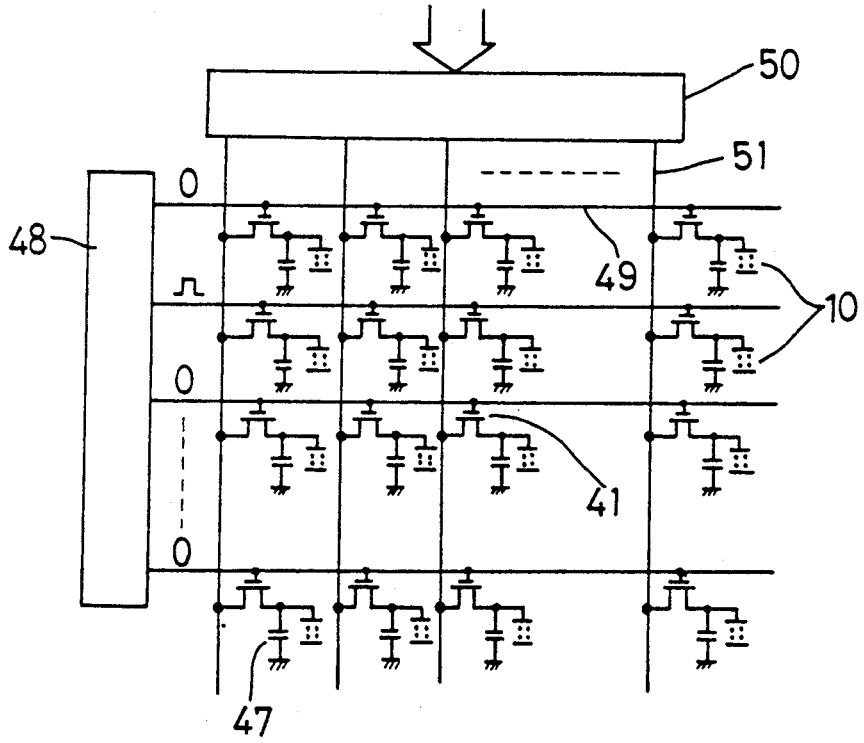
FIG. 5 is a block diagram showing a circuitry for driving the plasma display of FIG. 4.

FIG. 5 shows a circuitry for driving the plasma display 40, which includes signal storing capacitors 47, with the a-SiTFTs 41 acting as switching devices. A scanning circuit 48 successively scans Y-electrodes line after line, temporarily electrifying all the a-SiTFTs 41 on one gate bus 49. On the other hand, a hold circuit 50, upon receipt of a signal, supplies display signals to the capacitors 47 through drain buses 51. The signals thus stored are used to energize the light emitting element 10 allocated to pixels until a scanning operation for a next frame.

A second embodiment will be described next.

In this embodiment also, the light emitting element 10 was manufactured by using the vacuum apparatus shown in FIG. 1.

First, epoxy resin was dissolved in toluene, and the resin solution was modified by adding thereto 5 parts by weight of $Zn_2SiO_4$:Mn with respect to 100 parts by weight of expoxy resin.

The light emitting element 10 was manufactured in the same way as in the first embodiment excepting that xenon was used as the gas to be trapped in the bubbles, and that the internal pressure of the apparatus for introducing xenon gas was 600 Torr.

This light emitting element 10 was used to fabricate the light emitting device 30 shown in FIG. 3 as in the first embodiment. The light emitting device 30 was formed by successively applying to a 1 mm thick glass substrate, an aluminum electrode 32 in a film thickness of 3000 Å, the light emitting element 10 in a film thickness of 20 μm, an ITO transparent electrode 33 in a film thickness of 3000 Å and a 1 mm thick glass plate 34.

When the foregoing voltage was applied between the aluminum electrode 32 and ITO electrode 33 sandwiching the light emitting element 10, the xenon gas trapped in the fine bubbles 12 of the resin 11 gave plasma light emission. The light was reflected by the aluminum electrode 32 which resulted in green light emission through the ITO transparent electrode 33.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A method for manufacturing a light emitter material for giving plasma light emission upon application of an electric field comprising the steps of:

dissolving a resin in a solvent to provide a resin solution;

placing a vessel containing said resin solution in a vacuum apparatus;

evacuating said vacuum apparatus;

supplying a gas selected from the group consisting of rare gases, hydrocarbon gas and nitrogen gas to said vacuum apparatus to provide said resin solution with an atmosphere of said gas at a pressure or less than atmospheric pressure; and agitating said resin solution to generate fine, randomly dispersed bubbles having sizes smaller than an electrode for one pixel entrapping said gas in said resin solution.

2. The method as recited in claim 1 wherein said resin has a volume resistivity of $1\times10^{13}\Omega$. cm.

3. The method as recited in claim 1 wherein said rare gases include helium, neon, argon, krypton, xenon and radon gases.

4. The method as recited in claim 1 wherein said hydrocarbon gas includes methane, ethane and propane gases.

5. The method as recited in claim 1 and further including the step of dispersing a fluorescent material in said resin for varying a light emission wavelength.

6. A method for manufacturing a light emitting device for giving plasma light emission upon application of an electric field comprising the steps of:

providing a support member;

forming a first electrode on said support member;

providing a layer of a light emitting resin on said support member, said light emitting resin being manufactured by the steps of:

dissolving a resin in a solvent to provide a resin solution;

placing a vessel containing said resin solution in a vacuum apparatus;

evacuating said vacuum apparatus;

supplying a gas selected from the group consisting of rare gases, hydrocarbon gas and nitrogen gas to said vacuum apparatus to provide said resin solution with an atmosphere of said gas at a pressure of less than atmospheric pressure; and agitating said resin solution to generate fine, randomly dispersed bubbles having sizes smaller than an electrode for one pixel entrapping said gas in said resin solution; and forming a second electrode on said light emitting resin layer.

7. The method as recited in claim 6 wherein said step of providing said light emitting resin layer on said support member comprises coating said light emitting resin thereon.

8. The method as recited in claim 7 wherein said resin has a volume resistivity of $1\times10^{13}\Omega$.cm.

9. The method as recited in claim 7 wherein said rare gases include helium, neon, argon, krypton, xenon and radon gases.

10. The method as recited in claim 7 wherein said hydrocarbon gas includes methane, ethane and propane gases.

11. The method as recited in claim 7 and further including the step of dispersing a fluorescent material in said resin for varying a light emission wavelength.

12. A method for manufacturing a light emitting device for giving plasma light emission upon application of an electric field comprising the steps of:

providing a support member;

forming at least one pair of interdigital electrodes on said support member; and providing a layer of a light emitting resin on said support member, said light emitting resin being manufactured by the process of:

dissolving a resin in a solvent to provide a resin solution;

placing a vessel containing said resin solution in a vacuum apparatus;

evacuating said vacuum apparatus;

supplying a gas selected from the group consisting of rare gases, hydrocarbon gas and nitrogen gas to said vacuum apparatus to provide said resin solution with an atmosphere of said gas at a pressure of less than atmospheric pressure; and agitating said resin solution to generate fine, randomly dispersed bubbles having sizes smaller than an electrode for one pixel entrapping said gas in said resin solution.

13. The method as recited in claim 12 wherein said step of providing said light emitting resin layer on said support member comprises coating said light emitting resin thereon.

14. The method as recited in claim 12 wherein said resin has a volume resistivity of $1\times10^{13}\Omega$.cm.

15. The method as recited in claim 12 wherein said rare gases include helium, neon, argon, krypton, xenon and radon gases.

16. The method as recited in claim 12 wherein said hydrocarbon gas includes methane, ethane and propane gases.

17. The method as recited in claim 13 and further including the step of dispersing a fluorescent material in said resin for varying a light emission wavelength.

18. A method for manufacturing a plasma display utilizing a light emitting device for giving plasma light emission upon application of an electric field comprising the steps of:

providing a support member;

forming individual electrodes on said support member;

providing a layer of a light emitting resin comprising a light emitter material manufactured by the steps of:

dissolving a resin in a solvent to provide a resin solution;

placing a vessel containing said resin solution in a vacuum apparatus;

evacuating said vacuum apparatus;

supplying a gas selected from the group consisting of rare gases, hydrocarbon gas and nitrogen gas to said vacuum apparatus to provide said resin solution with an atmosphere of said gas at a pressure of less than atmospheric pressure; and agitating said resin solution to generate fine, randomly dispersed bubbles having sizes smaller than an electrode for one pixel entrapping said gas in said resin solution;

forming a controlling means on said support member for controlling the application of an electric field to the light emitting resin layer in response to a signal received from outside; and forming a common electrode on said light emitting resin layer.

19. The method as recited in claim 18, wherein said step of providing said light emitting resin layer on said support member comprises coating said light emitting resin thereon.

20. The method as recited in claim 18, wherein said resin has a volume resistivity of $1\times10^{13}\Omega$.cm.

21. The method as recited in claim 18, wherein said rare gases include helium, neon, argon, krypton, xenon and radon gases.

22. The method as recited in claim 18, wherein said hydrocarbon gas includes methane, ethane and propane gases.

23. The method as recited in claim 18 and further including the step of forming an RGB microcolor filter on said common electrode.

24. The method as recited in claim 18 and further including the step of dispersing a fluorescent material in said resin for varying a light emission wavelength.

25. The method as recited in claim 18, wherein said controlling means is a film transistor.

* * * * *